US006672833B2

(12) United States Patent
MacLean et al.

(10) Patent No.: US 6,672,833 B2
(45) Date of Patent: Jan. 6, 2004

(54) GAS TURBINE ENGINE FRAME FLOWPATH LINER SUPPORT

(75) Inventors: Thomas L. MacLean, Mason, OH (US); Tod K. Bosel, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 186 days.

(21) Appl. No.: 10/024,094

(22) Filed: Dec. 18, 2001

(65) Prior Publication Data

US 2003/0161727 A1 Aug. 28, 2003

(51) Int. Cl.[7] ..... F01D 25/24

(52) U.S. Cl. ..... 415/196; 415/116; 415/142; 415/173.1; 415/190

(58) Field of Search ..... 415/115, 116, 415/142, 190, 196, 170.1, 173.1, 173.6, 178, 176

(56) References Cited

U.S. PATENT DOCUMENTS

| | | | | |
|---|---|---|---|---|
| 5,127,793 A | * | 7/1992 | Walker et al. | 415/115 |
| 5,165,847 A | * | 11/1992 | Proctor et al. | 415/115 |
| 5,205,708 A | | 4/1993 | Plemmons et al. | |
| 5,211,534 A | * | 5/1993 | Catlow | 415/173.2 |
| 5,273,396 A | * | 12/1993 | Albrecht et al. | 415/173.1 |
| 5,292,227 A | | 3/1994 | Czachor et al. | |
| 5,438,756 A | | 8/1995 | Halchak et al. | |
| 5,483,792 A | | 1/1996 | Czachor et al. | |
| 5,553,999 A | | 9/1996 | Proctor et al. | |
| 5,593,277 A | | 1/1997 | Proctor et al. | |
| 5,609,467 A | | 3/1997 | Lenhart et al. | |
| 6,139,264 A | | 10/2000 | Schilling | |
| 6,164,656 A | | 12/2000 | Frost | |
| 6,196,792 B1 | * | 3/2001 | Lee et al. | 415/116 |

OTHER PUBLICATIONS

"GE Turbofan Engine—Engine Manual", GE Aircraft Engines, GEK 100700, Jun. 1, 1995, Revised May 1, 2001, 5 pages.

* cited by examiner

*Primary Examiner*—Edward K. Look
*Assistant Examiner*—J. M. McAleenan
(74) *Attorney, Agent, or Firm*—Nathan D. Herkamp; Steven J. Rosen

(57) ABSTRACT

An annular hanger for supporting an annular wall element from a gas turbine engine annular outer casing is circumscribed about a centerline extending in opposite first and second axial directions and has an annular first hook extending in the first axial direction from said body section and an annular second hook extending in the second axial direction. One of the hooks has circumferentially spaced apart tabs extending equal axial lengths from the body section and corresponding notches circumferentially disposed between a corresponding adjacent pair of the tabs. The annular hanger is used to support at least in part a wall element from the outer casing as part of a bayonet mount. The bayonet mount further includes a bayonet slot on one of the casing and the wall element and the hanger tabs are received within the bayonet slot.

17 Claims, 8 Drawing Sheets

GAS TURBINE ENGINE FRAME FLOWPATH LINER SUPPORT

BACKGROUND OF THE INVENTION

1. Field of the Invention

This invention relates to flowpath liners through gas turbine engine frames and, more particularly, to using hangers to mount such liners to casings having hooks.

2. Description of Related Art

A gas turbine engine of the turbofan type generally includes a forward fan and booster compressor, a middle core engine, and an aft low pressure power turbine. The core engine includes a high pressure compressor, a combustor, and a high pressure turbine in a serial flow relationship. The high pressure compressor and high pressure turbine of the core engine are interconnected by a high pressure shaft to from the high pressure rotor. The high pressure compressor is rotatably driven to compress air entering the core engine to a relatively high pressure. This high pressure air is then mixed with fuel in the combustor and ignited to form a high energy gas stream. The gas stream flows aft and passes through the high pressure turbine, rotatably driving it and the high pressure shaft which, in turn, rotatably drives the compressor.

The gas stream leaving the high pressure turbine is expanded through a second or low pressure turbine. The low pressure turbine rotatably drives the fan and booster compressor via a low pressure shaft, all of which form the low pressure rotor. The low pressure shaft extends through the high pressure rotor. Most of the thrust produced is generated by the fan. Engine frames are used to support and carry the bearings which, in turn, rotatably support the rotors. Conventional turbofan engines have a fan frame, a mid-frame, and an aft turbine frame. Bearing supporting frames are heavy and add weight, length, and cost to the engine.

The mid-frame typically has an external casing and an internal hub which are attached to each other through a plurality of multiple radially extending struts. A flowpath frame liner provides a flowpath that guides and directs hot engine gases through the frame and is not intended to carry any structural loads. The flowpath frame liner includes a radially outer liner, a radially inner liner, and multiple fairings disposed between the outer and inner liners. In some gas turbine engines, the frame liner is segmented and fairing segments have hollow airfoils extending between radially inner and outer band segments. Radially inner and outer liner segments are circumferentially disposed between the inner and outer band segments, respectively.

The flowpath frame liner protects the struts and rest of the frame from the hot gases passing through the frame. Attaching the flowpath liner to the external casing of the frame has always been a challenge to engine designers. The flowpath liner is exposed to the hot engine gases whereas the casing is not. This presents a thermal mismatch between the casing and flowpath liner during engine transients. The attachment of the flowpath liner to the casing must accommodate differential thermal growth between the casing and flowpath liner. One current design for attaching the flowpath liners to the casing includes the use of a plurality of hangers. The hangers are attached between the casing and the flowpath liners in such a way as to support the liners and allow them to move relative to the casing to accommodate the differential thermal growth between the casing and flowpath liner. The outer liners and the fairings are separate segments. There are forward and aft hangers.

The aft hangers are bolted to the casing and the liner and fairing segments. Axially extending joints circumferentially disposed between the hangers and the liner and fairing segments allow for relative movement along the direction of mating surfaces. The forward hangers are bolted to hooks in the casing and in the liner and fairing segments. The forward hangers have circumferentially spaced apart tabs that protrude axially forward and these tabs are disposed through slots cut in a forward casing ring. A typical hanger may have three tabs and a C-clip is press fit onto the tabs and secure the hangers to the forward casing ring. One of the tabs has a longer axial length than the other two and protrudes through a slot in the C-clip to prevent rotation of the C-clip. The added length may be in the form of a pin instead the entire width of the tab being longer.

It is desirable to have a lower cost, lighter weight, and more durable and robust support means to attach the flowpath liner to the casing. It is desirable to have a support means that reduces assembly and disassembly time as compared to present designs. The C-clips are subject to cracking and are frequently replaced during engine overhaul and, thus, a more durable and robust support means is desired.

BRIEF DESCRIPTION OF THE INVENTION

An annular hanger for supporting an annular wall element from a gas turbine engine annular outer casing. The annular hanger having an annular body section circumscribed about a centerline extending in opposite first and second axial directions, an annular first hook extending in the first axial direction from said body section, and an annular second hook extending in the second axial direction, opposite that of said first axial direction, from the body section. One of the hooks has circumferentially spaced apart hanger tabs, such as three in the exemplary embodiment, extending equal axial lengths from the body section and a corresponding number of notches wherein each of the notches is circumferentially disposed between a corresponding adjacent pair of the hanger tabs.

In the exemplary embodiment of the invention illustrated herein, the first hook includes the tabs and the annular hanger further comprises a third annular hook extending in the second axial direction from the body section. The second and third annular hooks extend in the second axial direction from said body section and the third annular hook is located radially inwardly of the second annular hook. The first hook includes the hanger tabs and the annular hanger further includes a third annular hook extending in said second axial direction from said body section.

The invention also includes a gas turbine engine frame liner assembly with an annular outer casing, an annular wall element mounted to and spaced radially inwardly of the outer casing, and the annular hanger supporting at least in part the wall element from the outer casing. The circumferentially spaced apart hanger tabs is part of a bayonet mount supporting at least in part the wall element from the outer casing. The bayonet mount further includes a bayonet slot on one of the casing and the wall element and the hanger tabs are received within the bayonet slot. The bayonet slot is bounded by an annular bayonet hook having a plurality of circumferentially spaced apart bayonet tabs and a corresponding plurality of bayonet spaces, each of which is circumferentially disposed between each pair of the bayonet tabs.

The invention also includes a gas turbine engine frame assembly having a frame with the annular outer casing and an annular inner hub circumscribed about the centerline and spaced radially inwardly from the casing. A plurality of circumferentially spaced apart hollow struts extending radially between the outer casing and the hub and a circumferentially disposed plurality of the annular wall elements are mounted to and spaced radially inwardly of the outer casing supported by a circumferentially disposed plurality of the annular hangers. In a more particular embodiment of the invention, the wall elements are circumferentially alternating outer liner segments and outer fairing platforms of fairing segments.

The hangers and bayonet mounts of the present invention provide a lower cost, lighter weight, and more durable and robust support means to attach wall elements to a gas turbine engine casing. The bayonet mount of the present invention can also reduce assembly and disassembly time as compared to present designs. The present invention eliminates C-clips and cracking and frequent replacement of the C-clips during engine overhaul and provides a more durable and robust support means.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
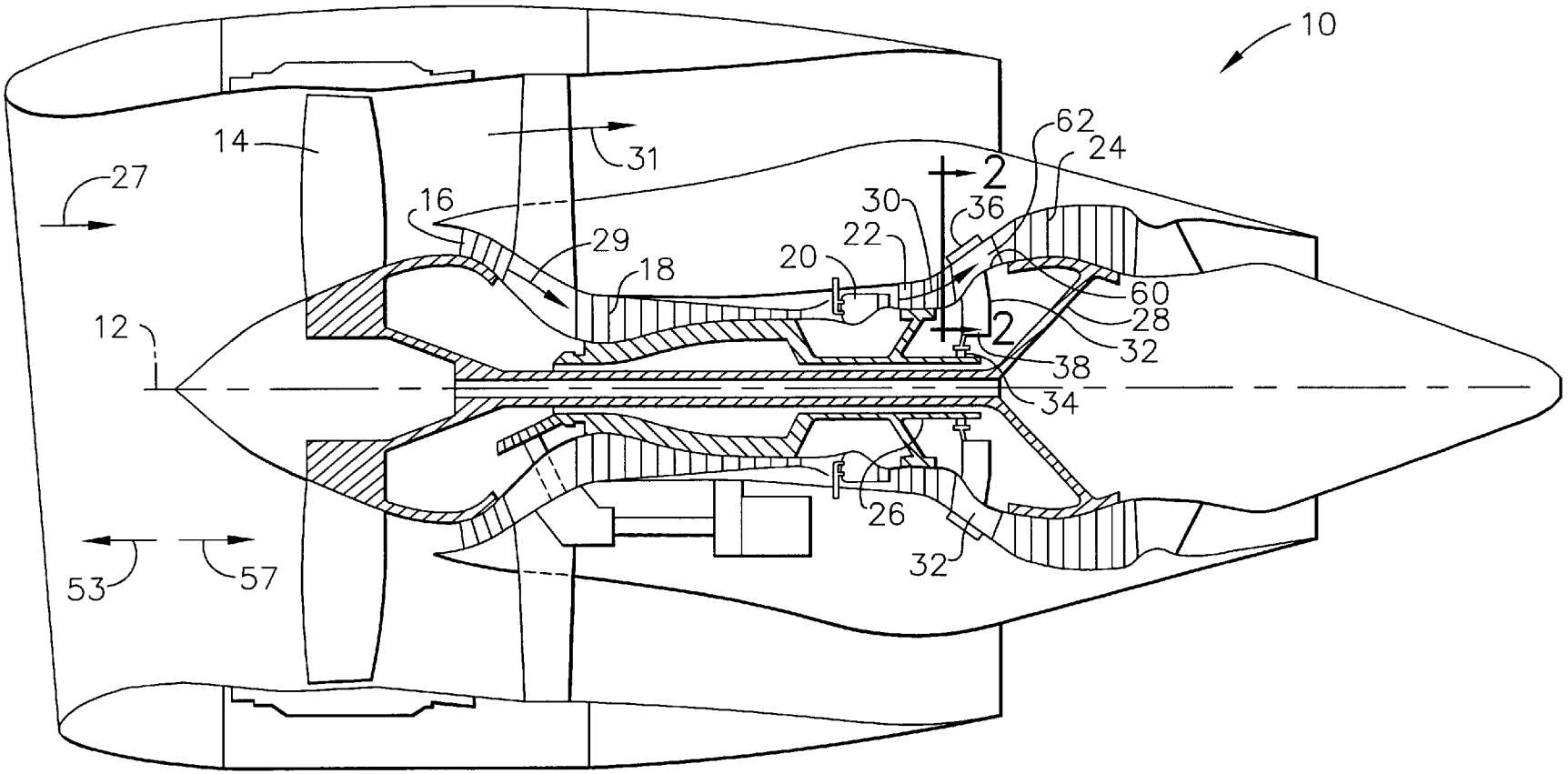
FIG. 1 is a longitudinal cross-sectional view illustration of an exemplary gas turbine engine incorporating a turbine center frame which has a support means of the present invention for attaching a frame flowpath liner to a casing of the frame.

FIG. 1 illustrates a longitudinal cross-section of an exemplary gas turbine engine 10. The engine 10 includes, in serial axial flow communication, about an axially extending longitudinal centerline 12, a fan 14, booster 16, high pressure compressor 18, combustor 20, high pressure turbine 22 and low pressure turbine 24. The high pressure turbine 22 is drivingly connected to the high pressure compressor 18 with a first rotor shaft 26 and low pressure turbine 24 is drivingly connected to both the booster 16 and fan 14 with a second rotor shaft 28. During operation of engine 10, ambient air 27 enters the engine inlet and a first portion, commonly denoted as the primary or core gas stream 29, passes through the fan 14, booster 16, and high pressure compressor 18, being pressurized by each component in succession. The primary gas stream then enters the combustor 20 where the pressurized air is mixed with fuel to provide a high energy gas stream 30. The high energy gas stream 30 then enters in succession the high pressure turbine 22 where it is expanded, with energy extracted to drive the high pressure compressor 18 and low pressure turbine 24, where it is further expanded with energy being extracted to drive the fan 14 and booster 16. A second portion of the ambient air 27 entering the engine inlet, commonly denoted as the secondary or bypass air flow 31, passes through the fan 14 before exiting the engine 10 through an outer annular duct, which is formed between a nacelle and core cowl, wherein the bypass air flow 31 provides a significant portion of the engine thrust. Engine 10 includes an annular turbine center frame 32 which is positioned between high pressure turbine 22 and low pressure turbine 24.

Figure 3:
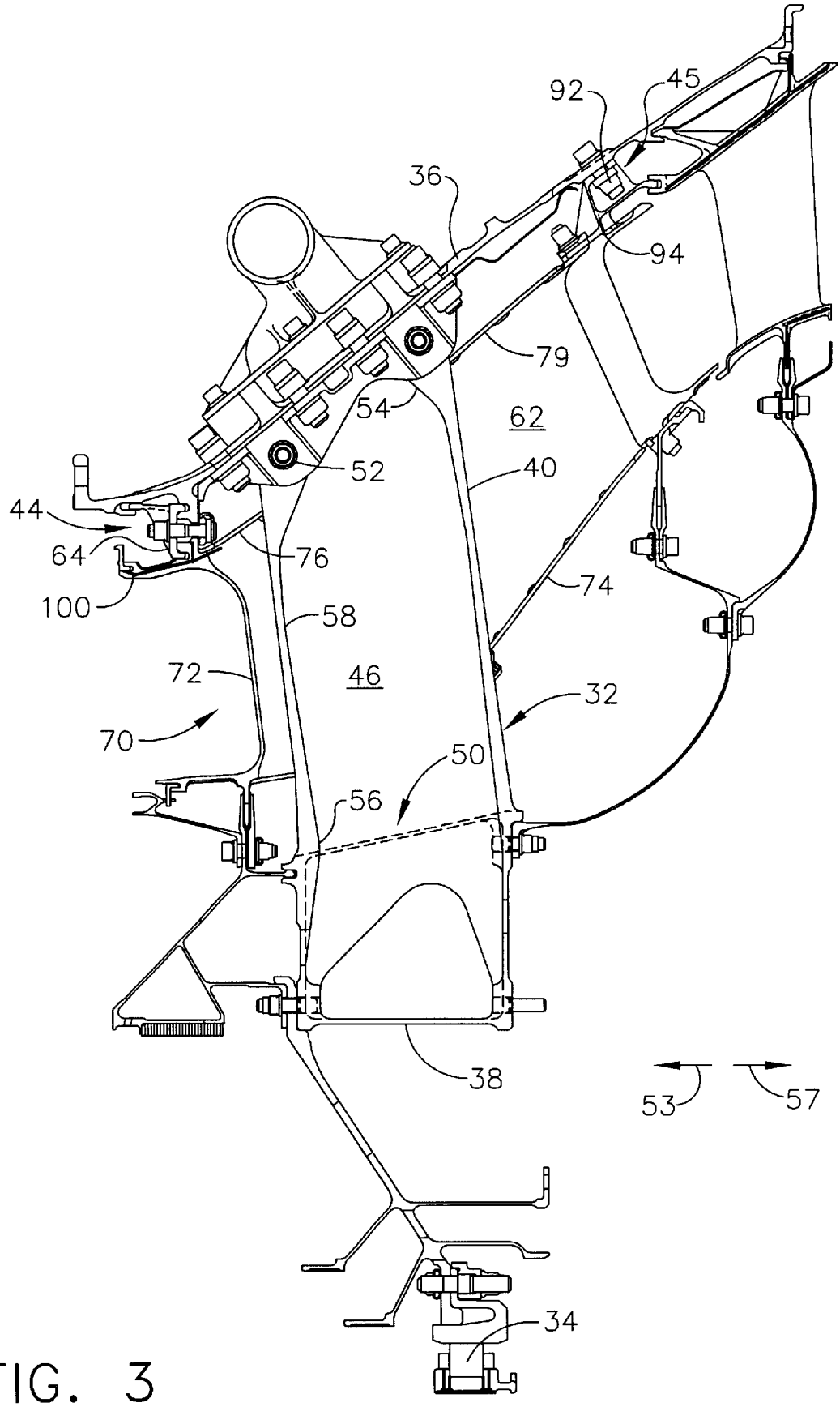
FIG. 3 is an enlarged longitudinal cross-sectional view illustration of the frame in FIG. 1 and an exemplary fairing segment of the flowpath frame liner supported by a support means of the present invention.

Referring to FIGS. 1 and 3, the turbine center frame 32 supports a bearing 34 which in turn rotatably supports one end of the first rotor shaft 26. Turbine center frame 32 is disposed downstream of high pressure turbine 22 and is protected from the high energy gas stream, or combustion gases which flow therethrough by a flowpath frame liner 60 which provides a flowpath 62 that guides and directs hot engine gases through the frame 32. The turbine center frame 32 includes an annular outer casing 36, or first structural ring circumscribed about the centerline 12. The frame 32 also includes an annular inner hub 38 or second structural ring, disposed coaxially with the outer casing 36 about the centerline 12 and spaced radially inwardly from casing 36. A plurality of circumferentially spaced apart hollow struts 40 extend radially between outer casing 36 and inner hub 38 and are fixedly joined to casing 36 and hub 38.

Each of the struts 40 includes a first or outer end 54 and a radially opposite second or inner end 56 with an elongated center portion 58 extending therebetween. The strut 40 is hollow and includes a through channel 46 extending completely through the strut 40 from the outer end 54 and through the center portion 58 to the inner end 56. The outer casing 36 includes a plurality of circumferentially spaced apart ports (not shown) extending radially therethrough and the hub 38 also includes a plurality of circumferentially spaced apart through ports 50. The casing ports, channel 46 and ports 50 are in flow communication with one another.

The inner ends 56 of the struts 40 are integrally formed with the hub 38 in a common casing and the outer ends 54 of the struts 40 are removably fastened to outer casing 36. Turbine frame 32 includes a plurality of devises 52 which removably join the strut outer ends 54 to outer casing 36. Each of the devises 52 is disposed between a respective one of the strut ends and casing 36, in alignment with respective ones of the casing ports for removably joining the strut 40 to the casing 36, for both carrying loads and providing access therethrough. Other arrangements of the clevises, outer casing, hub, and struts are well known and one particularly useful frame design are disclosed in U.S. patent application Ser. No. 09/561,773 entitled "TURBINE FRAME ASSEMBLY" and U.S. patent application Ser. No. 09/561,771 entitled "TURBINE FRAME ASSEMBLY"

Figure 2:
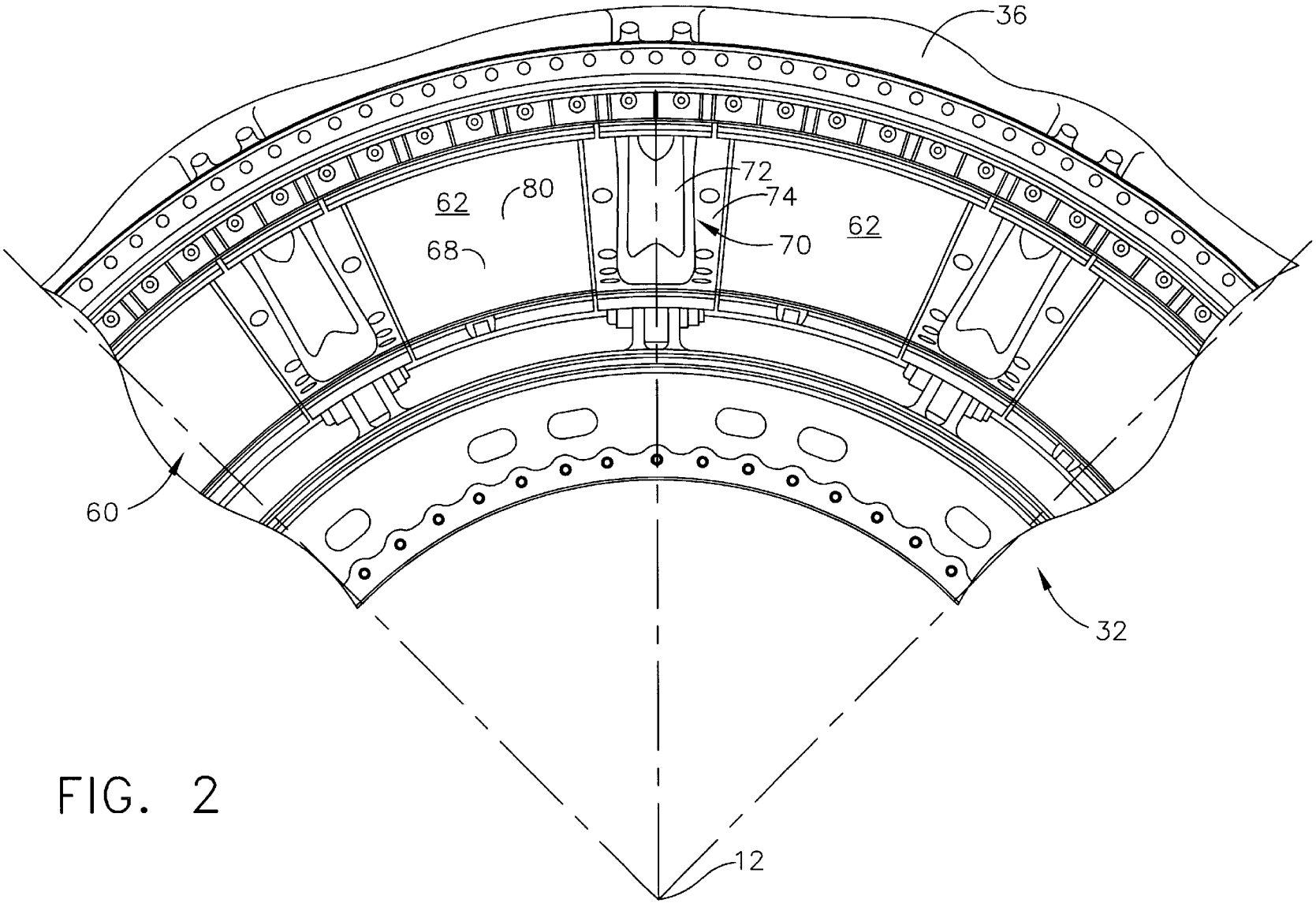
FIG. 2 is a radial cross-sectional view illustration of a sector of the turbine center frame through 2—2 in FIG. 1.
Figure 4:
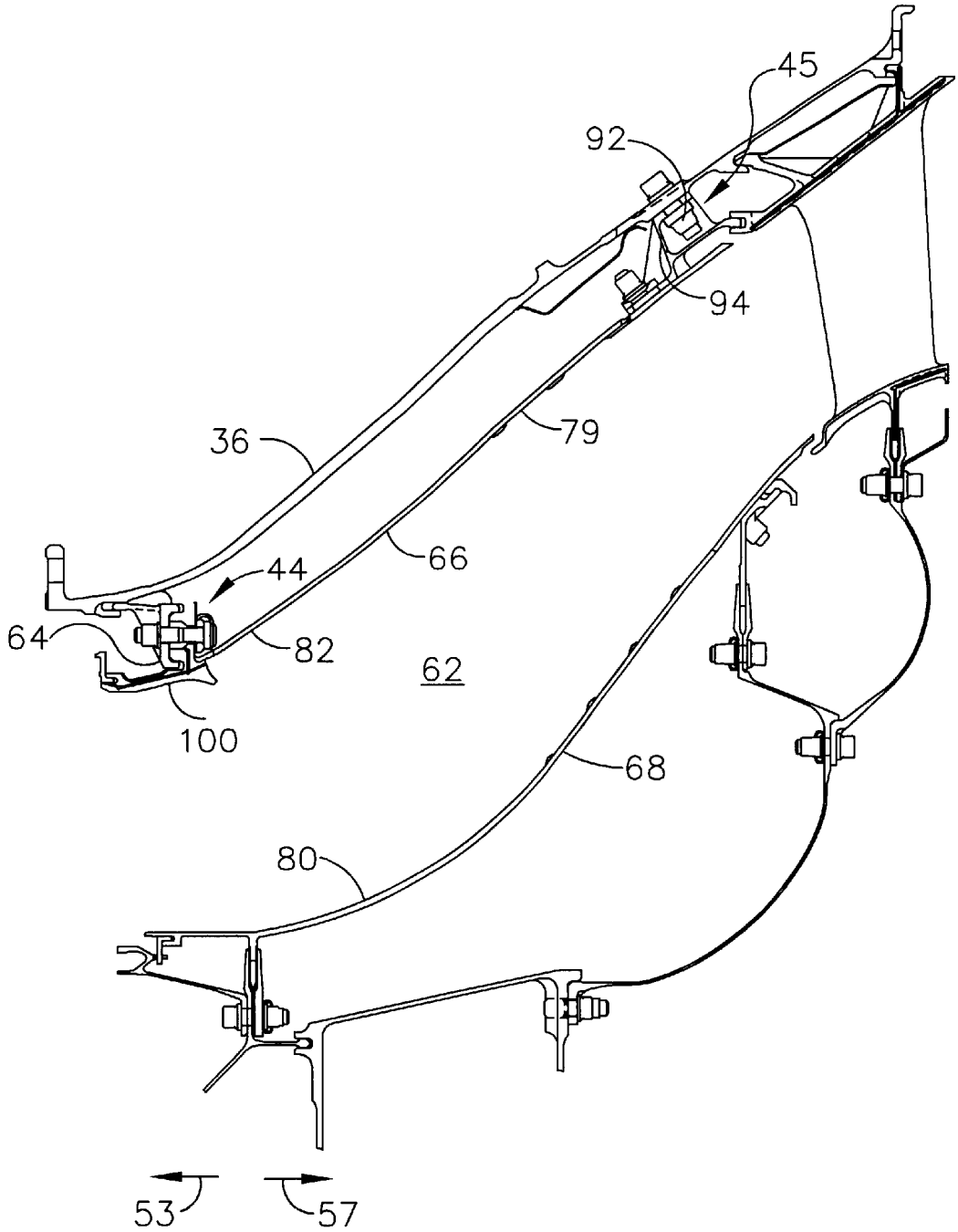
FIG. 4 is an enlarged longitudinal cross-sectional view illustration of the frame in FIG. 1 and exemplary outer and inner liners of the flowpath frame liner supported by a support means of the present invention.

Referring further to FIGS. 2 and 4, the flowpath frame liner 60 includes a radially outer liner 66, a radially inner liner 68 spaced radially inwardly of the outer liner 66. Referring further to FIG. 3, the exemplary flowpath frame liner 60 illustrated herein, as in other conventional gas turbine engines, is segmented includes fairing segments 70 having hollow airfoils 72 extending radially between radially inner and outer fairing platforms 74 and 76. The radially inner liner and outer liner 66 are segmented into radially inner liner segments 80 and outer liner segments 82 which are circumferentially disposed between the inner and outer fairing platforms 74 and 76, respectively. Each of the hollow airfoils 72 surrounds a respective one of the struts 40 for protecting the struts 40 from the high temperature combustion gases in the high energy gas stream 30 which flow between struts 40.

Figure 5:
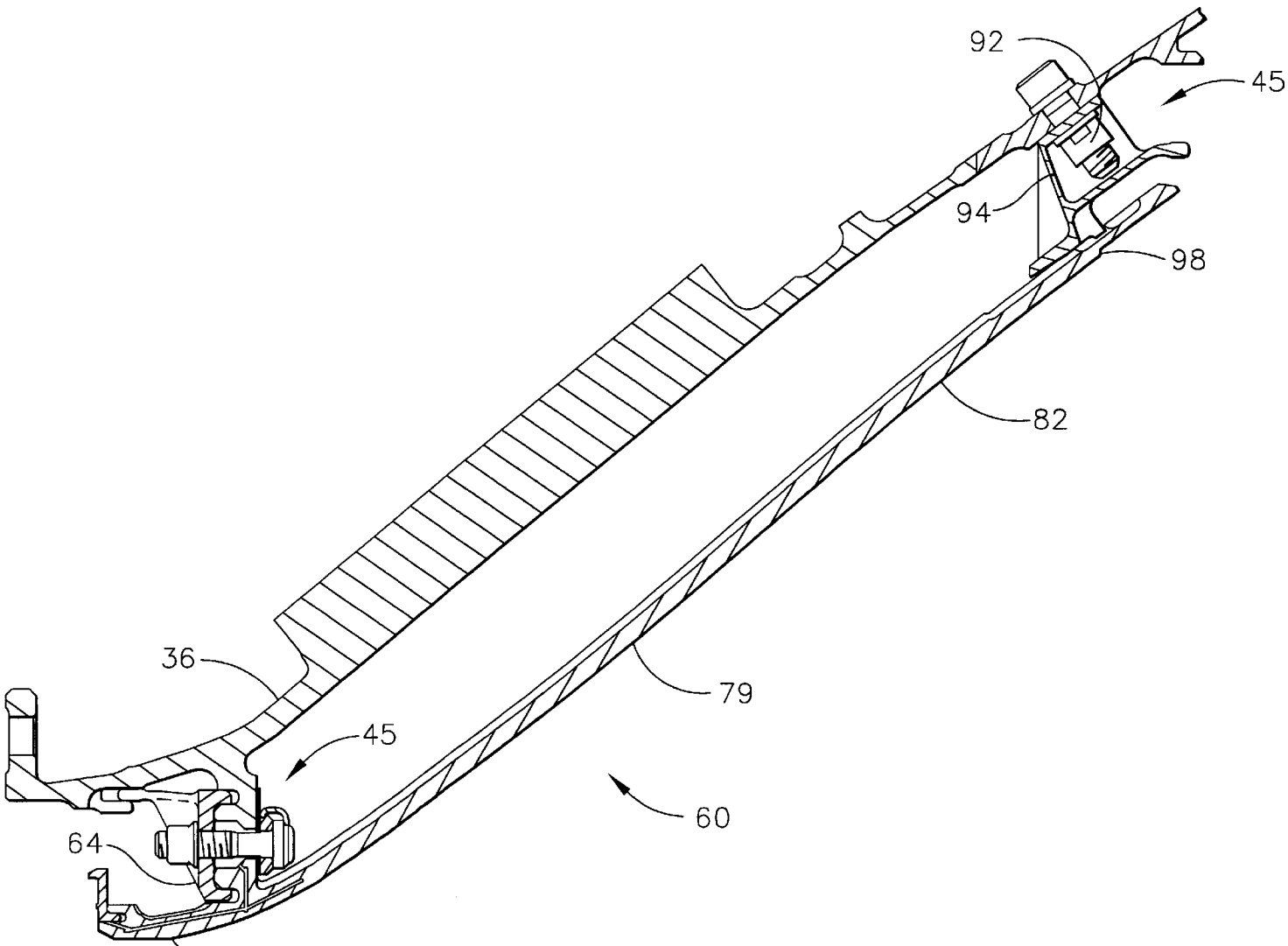
FIG. 5 is an enlarged longitudinal cross-sectional view illustration of an exemplary outer liner element of the flowpath liner in FIG. 1 supported by the support means of the present invention.

The centerline 12 extends in opposite first and second axial directions illustrated as forward and aft directions 53 and 57 as illustrated in FIGS. 1 and 2. The frame 32 supports the flowpath frame liner 60 using forward and aft mount assemblies 44 and 45 illustrated in FIGS. 3, 4, and 5. The outer fairing platforms 76 and the outer liner segments 82 are attached to the outer casing 36 with the forward and aft mount assemblies 44 and 45, respectively. The flowpath frame liner 60 is exposed to the hot engine gases whereas the outer casing 36 is not. This presents a thermal mismatch between the casing 36 and flowpath frame liner 60 during engine transients. The attachment of the flowpath frame liner 60 to the casing 36 must accommodate differential thermal growth between the casing 36 and flowpath frame liner 60 and, in particular, between the outer casing 36 and radially inwardly disposed annular wall elements 79 of the flowpath frame liner. The annular wall elements 79 illustrated herein are the outer liner segments 82 and the outer fairing platforms 76 of the fairing segments 70. The aft mount assemblies 45 includes aft nut and bolt assemblies 92 and brackets 94 to attach aft ends 98 of the outer fairing platforms 76 and the outer liner segments 82 to the outer casing 36. The forward mount assemblies 44 includes a plurality of hangers 64 to attach forward ends 100 to the outer casing 36.

Figure 6:
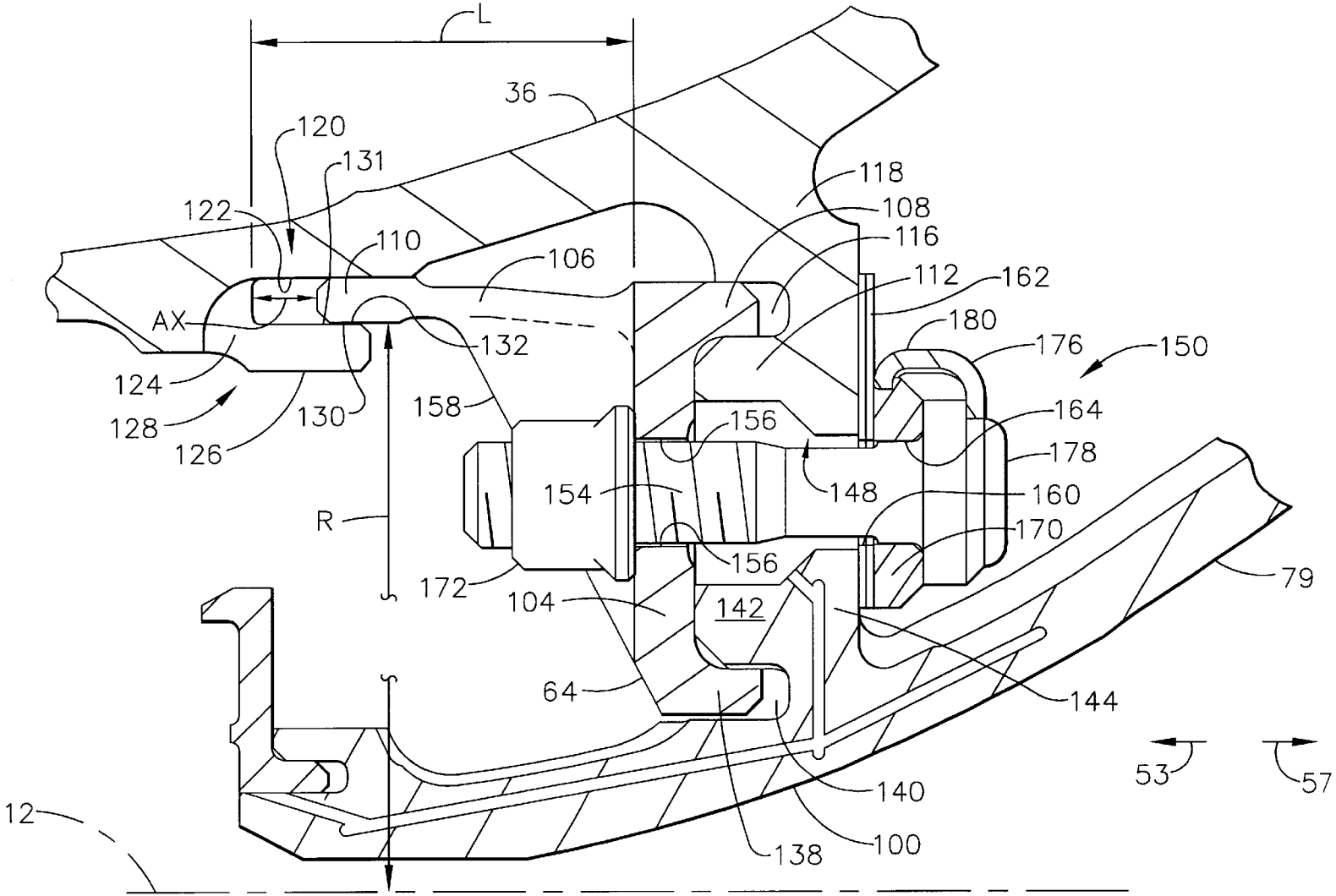
FIG. 6 is an enlarged longitudinal cross-sectional view illustration of the support means and the outer liner element in FIG. 5.
Figure 7:
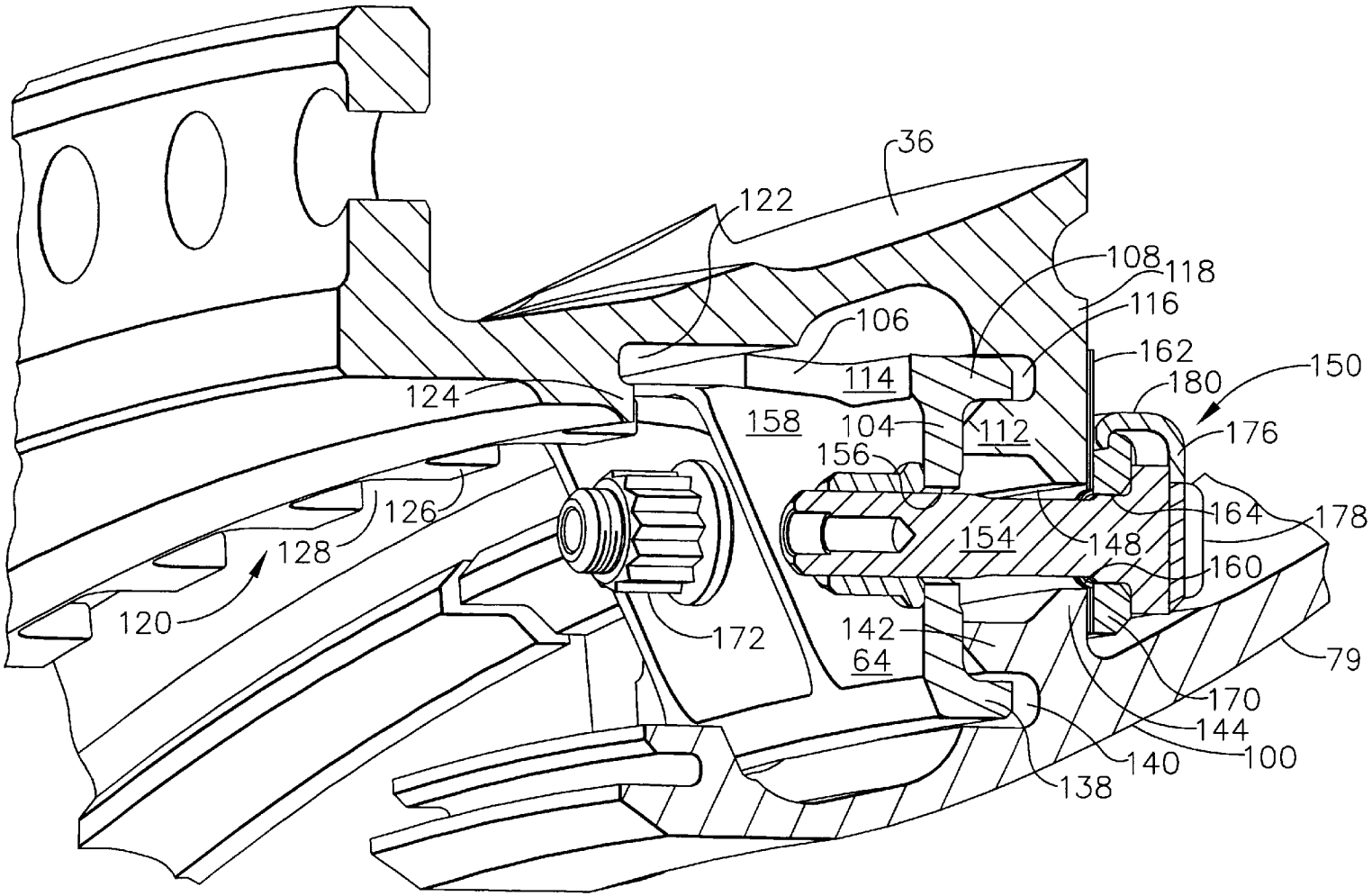
FIG. 7 is a partially cutaway perspective view illustration of the support means and the outer liner element in FIG. 5.
Figure 8:
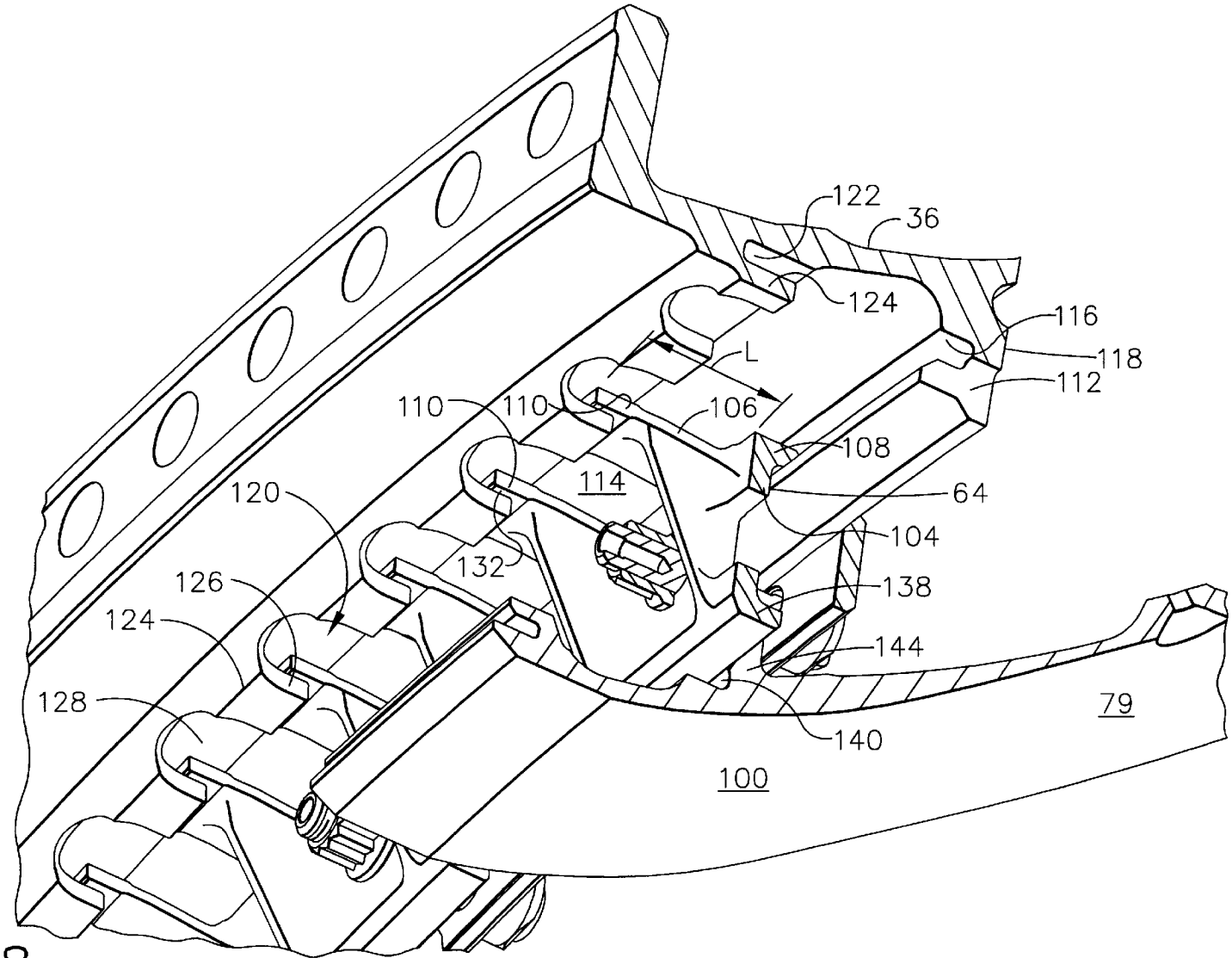
FIG. 8 is a partially cutaway perspective view illustration of an exemplary outer liner element of the flowpath liner in FIG. 1 supported by the support means of the present invention.

Referring to FIGS. 6, 7, and 8, the hangers 64 have an annular body section 104 circumscribed about the centerline 12. An annular first hook 106 extends in the first axial direction, illustrated as the forward direction 53, from the body section 104. An annular second hook 108 extends in the second axial direction, illustrated as the aft direction 57, from the body section 104. One of the first and second hooks 106 and 108 includes a circumferentially spaced apart hanger tabs 110 extending equal axial lengths L from the body section. In the exemplary embodiment of the invention, the first hook 106 includes three of the circumferentially spaced apart hanger tabs 110 and two hanger notches 114 wherein each of the notches is circumferentially disposed between each two adjacent ones of the tabs 110. The annular second hook 108 extends in the aft direction and is received within an annular casing slot 116 in a radially inwardly depending casing flange 118 of the outer casing 36. The casing slot 116 is bounded radially inwardly by a casing hook 112 extending from axially forwardly from the casing flange 118.

A bayonet mount 120 is used to connect the first hook 106 to the outer casing 36. The bayonet mount 120 includes the spaced apart hanger tabs 110 received within a bayonet slot 122 which is bounded by a bayonet hook 124 extending axially from the casing 36. The bayonet hook 124 includes a plurality of circumferentially spaced apart bayonet tabs 126 and a corresponding plurality of bayonet spaces 128 wherein each of the bayonet spaces is circumferentially disposed between two adjacent ones of the bayonet tabs. The bayonet tabs 126 and bayonet spaces 128 and the hanger tabs 110 and the hanger notches 114 are shaped and sized to cooperate to provide the bayonet mount. The bayonet tabs 126 have a first or bayonet tab radius R as measured from the centerline 12 to a radially outer surface 131 of the bayonet tabs 126 and a radially inner surface 130 of the hanger tabs 110, as illustrated in FIG. 6. This allows the hanger tabs 110 to be placed in between the bayonet tabs 126 during assembly. There is a sufficient clearance 132 between the radially outer surface 131 and the radially inner surface 130 such that the hanger may then be rotated about the centerline 12 such that the radially outer surface 131 mates with the radially inner surface 130 which secures the hanger tabs within the bayonet slot 122. There is a sufficient axial clearance AX within the bayonet slot 122 and the hanger tabs 110 to accommodate assembly.

The hanger 64 illustrated herein has an annular third hook 138 spaced radially inwardly of the annular second hook 108 and extends in the second axial direction, illustrated as the aft direction 57, from the body section 104. The third hook 138 is received within an annular wall slot 140 in a radially outwardly extending wall flange 144 of the wall elements 79 of the flowpath frame liner 60 which are illustrated herein as the outer liner segments 82 and the outer fairing platforms 76. The wall slot 140 is bounded by a wall hook 142. The casing and wall hooks 112 and 142 are secured within an annular space 148 between the second and third hooks 108 and 138 of the hanger 64 by a forward nut and bolt assembly 150.

Referring more specifically to FIGS. 6 and 7, the bolt assembly 150 includes bolts 154 disposed through first bolt holes 156 in the annular body section 104 of the hanger 64 between triangular gussets 158 extending between the body section and the first hook 106. The bolts 154 extend aftwardly through the space 148 between the casing flange 118 and the wall flange 144 and through second bolt holes 160 of seals 162 which seals an annular gap between the casing and wall flanges. The bolts 154 extend further aftwardly through third bolt holes 164 in an annular back plate 170. Nuts 172 are threaded on forward threaded ends of the bolt 154. Anti-rotation flanges 176 are secured to bolt heads 178 of the bolts 154 and have bent over arms 180 which engage the back plate 170 to prevent the bolts from rotating when the nuts 172 are tightened.

The hangers 64 and bayonet mount 120 are illustrated herein for use in a forward mount assembly 44 for use with wall elements 79 of the flowpath frame liner 60 such as the outer liner segments 82 and the outer fairing platforms 76. Such mount assemblies can be used in various parts of gas turbine engine where annular liners and liner segments and other hot annular walls or elements and/or their segments are mounted to cooler casings. Various arrangements of the hooks and slots of the hangers and the hooks and slots of the cooled annular casing and heated annular walls and wall segments are also contemplated by the present invention.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

While the preferred embodiment of our invention has been described fully in order to explain its principles, it is understood that various modifications or alterations may be made to the preferred embodiment without departing from the scope of the invention as set forth in the appended claims.

What is claimed is:

1. An annular hanger comprising:

an annular body section circumscribed about a centerline extending in opposite first and second axial directions, an annular first hook extending in said first axial direction from said body section, an annular second hook extending in said second axial direction, opposite that of said first axial direction, from said body section, and one of said hooks having circumferentially spaced apart hanger tabs extending equal axial lengths from the body section.

2. An annular hanger as claimed in claim 1, further comprising a hanger notches wherein each of said hanger notches is circumferentially disposed between a corresponding adjacent pair of said hanger tabs.

3. An annular hanger as claimed in claim 1, wherein said first hook includes said hanger tabs and said annular hanger further comprises a third annular hook extending in said second axial direction from said body section.

4. An annular hanger as claimed in claim 3, wherein said second and third annular hooks extend in said second axial direction from said body section and said third annular hook is located radially inwardly of said second annular hook.

5. An annular hanger as claimed in claim 2, wherein said first hook includes said hanger tabs and said annular hanger further comprises a third annular hook extending in said second axial direction from said body section.

6. An annular hanger as claimed in claim 5, wherein said first and second annular hooks extend in said second axial direction from said body section and said second annular hook is located radially inwardly of said first annular hook.

7. A gas turbine engine frame liner assembly comprising:

an annular outer casing, an annular wall element mounted to and spaced radially inwardly of said outer casing, an annular hanger supporting at least in part said wall element from said outer casing, said hanger, casing, and wall element circumscribed about a common centerline, a bayonet mount operably associated with said hanger for supporting at least in part said wall element from said outer casing, and said hanger having circumferentially spaced apart hanger tabs extending equal axial lengths from the body section.

8. An assembly as claimed in claim 7, wherein said hanger includes an annular body section circumscribed about said centerline extending in opposite first and second axial directions, an annular first hook extending in said first axial direction from said body section, an annular second hook extending in said second axial direction from said body section, and one of said hooks includes said hanger tabs.

9. An assembly as claimed in claim 8, further comprising corresponding hanger notches wherein each of said hanger notches is circumferentially disposed between each pair of said hanger tabs.

10. An assembly as claimed in claim 9, wherein bayonet mount further includes a bayonet slot on one of said casing and said wall element, said hanger tabs received within said bayonet slot, and said bayonet slot bounded by an annular bayonet hook having a plurality of circumferentially spaced apart bayonet tabs and a corresponding plurality of bayonet spaces wherein each of said bayonet spaces is circumferentially disposed between each pair of said bayonet tabs.

11. A gas turbine engine frame assembly comprising:

a frame having an annular outer casing circumscribed about a centerline, an annular inner hub circumscribed about said centerline and spaced radially inwardly from said casing, a plurality of circumferentially spaced apart hollow struts extending radially between said outer casing and said hub, a circumferentially disposed plurality of annular wall elements mounted to and spaced radially inwardly of said outer casing, a circumferentially disposed plurality of annular hangers, each one of said hangers supporting at least in part a corresponding one of said wall elements from said outer casing, said hanger and wall elements circumscribed about said centerline, bayonet mounts operably associated with said hangers for supporting said wall elements from said outer casing, and said hangers having circumferentially spaced apart hanger tabs extending equal axial lengths from the body section.

12. An assembly as claimed in claim 11, wherein said wall elements include circumferentially alternating outer liner segments and outer fairing platforms of fairing segments.

13. An assembly as claimed in claim 12, wherein each of said hangers includes an annular body section circumscribed about said centerline extending in opposite first and second axial directions, an annular first hook extending in said first axial direction from said body section, an annular second hook extending in said second axial direction from said body section, and one of said hooks includes said hanger tabs.

14. An assembly as claimed in claim 13, further comprising hanger notches wherein each of said hanger notches is circumferentially disposed between each pair of said hanger tabs.

15. An assembly as claimed in claim 14, wherein each of said bayonet mounts further includes a bayonet slot on one of said casing and said wall element, said hanger tabs received within said bayonet slot, and said bayonet slot bounded by an annular bayonet hook having a plurality of circumferentially spaced apart bayonet tabs and a corresponding plurality of bayonet spaces wherein each of said bayonet spaces is circumferentially disposed between each pair of said bayonet tabs.

16. An assembly as claimed in claim 15, further comprising said second hook received within an annular casing slot in a radially inwardly depending casing flange of said casing and said casing slot bounded radially inwardly by a casing hook extending from axially forwardly from said casing flange.

17. An assembly as claimed in claim 16, further comprising:

an annular third hook spaced radially inwardly of said second hook and extending in said second axial direction from said body section, said third hook received within an annular wall slot in a radially outwardly extending wall flange of said outer liner segments and outer fairing platforms, and said wall slot bounded by an annular wall hook.

* * * * *